US010865367B2

(12) United States Patent
Olson et al.

(10) Patent No.: US 10,865,367 B2
(45) Date of Patent: Dec. 15, 2020

(54) METHOD OF DISHWASHING COMPRISING DETERGENT COMPOSITIONS SUBSTANTIALLY FREE OF POLYCARBOXYLIC ACID POLYMERS

(71) Applicant: Ecolab USA Inc., Saint Paul, MN (US)

(72) Inventors: Erik C. Olson, Saint Paul, MN (US); Carter M. Silvernail, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 127 days.

(21) Appl. No.: 16/018,337

(22) Filed: Jun. 26, 2018

(65) Prior Publication Data

US 2018/0371381 A1 Dec. 27, 2018

Related U.S. Application Data

(60) Provisional application No. 62/524,839, filed on Jun. 26, 2017.

(51) Int. Cl.
*C11D 7/36* (2006.01)
*C11D 11/00* (2006.01)
(Continued)

(52) U.S. Cl.
CPC ..... *C11D 11/0035* (2013.01); *C11D 3/0047* (2013.01); *C11D 7/265* (2013.01);
(Continued)

(58) Field of Classification Search
CPC ..... A47L 15/0005; A47L 15/0007; C11D 11/0035; C11D 11/0064; C11D 3/0047; C11D 7/265; C11D 7/36
See application file for complete search history.

(56) References Cited

U.S. PATENT DOCUMENTS 3,741,901 A * 6/1973 Ziffer ..... C11D 3/0042 8/137
4,678,596 A 7/1987 Dupre et al.
(Continued)

FOREIGN PATENT DOCUMENTS

EP 0177109 A2 4/1986
EP 0308221 A1 3/1989
(Continued)

OTHER PUBLICATIONS

Nagarajan, M. K., "Multi-Functional Polyacrylate Polymers in Detergents", JAOCS, vol. 62, No. 5, pp. 949-955. May 5, 1985.
(Continued)

*Primary Examiner* — Mark Kopec
*Assistant Examiner* — Jaison P Thomas
(74) *Attorney, Agent, or Firm* — McKee, Voorhees & Sease, PLC

(57) ABSTRACT

Methods of dishwashing to remove soils are disclosed, including a first detergent wash step, wherein the detergent is substantially-free of water conditioning agents including polycarboxylic acid polymers and phosphonates, followed by a second step of rinsing under high temperature with a water conditioning agent, namely polycarboxylic acid polymers. The methods result in little to no precipitation forming on the treated ware due to the treating of the hard water before it contacts the alkalinity source which prevents precipitation and/or flocculation from occurring.

20 Claims, 5 Drawing Sheets

(51) Int. Cl.
*C11D 7/26* (2006.01)
*C11D 3/00* (2006.01)
*A47L 15/00* (2006.01)

(52) U.S. Cl.
CPC ..... *C11D 7/36* (2013.01); *C11D 11/0064* (2013.01); *A47L 15/0005* (2013.01); *A47L 15/0007* (2013.01)

(56) References Cited

U.S. PATENT DOCUMENTS

| | | | | |
|---|---|---|---|---|
| 4,844,744 | A | 7/1989 | Leiter et al. | |
| 5,376,300 | A | 12/1994 | Bolkan et al. | |
| 5,395,547 | A | 3/1995 | Broadwell et al. | |
| 5,431,836 | A | 7/1995 | Carr et al. | |
| 5,431,838 | A | 7/1995 | Carr et al. | |
| 5,496,376 | A | 3/1996 | Falotico et al. | |
| 6,210,600 | B1 * | 4/2001 | Zhou | C11D 3/3769 134/25.2 |
| 6,630,440 | B1 | 10/2003 | Song et al. | |
| 10,047,325 | B2 * | 8/2018 | Dahlquist Howlett | A47L 15/0007 |
| 2003/0015219 | A1 | 1/2003 | Kravitz et al. | |
| 2005/0101516 | A1 | 5/2005 | Kieffer et al. | |
| 2006/0016716 | A1 * | 1/2006 | Fregonese | B29C 45/0001 206/524.7 |
| 2008/0274928 | A1 | 11/2008 | Smith et al. | |
| 2010/0300493 | A1 | 12/2010 | Snodgrass et al. | |
| 2011/0130322 | A1 | 6/2011 | Song | |
| 2013/0045909 | A1 | 2/2013 | Silvernail et al. | |
| 2014/0053611 | A1 * | 2/2014 | Klos | D06F 39/02 68/12.13 |
| 2014/0121150 | A1 | 5/2014 | Walters et al. | |
| 2014/0261564 | A1 | 9/2014 | Miralles | |
| 2015/0099686 | A1 | 4/2015 | Silvernail et al. | |
| 2015/0132833 | A1 | 5/2015 | Chan et al. | |
| 2015/0133357 | A1 | 5/2015 | Dotzauer et al. | |
| 2015/0284663 | A1 | 10/2015 | Miralles | |
| 2015/0307817 | A1 * | 10/2015 | Peitersen | C11D 3/38627 134/4 |
| 2015/0329804 | A1 | 11/2015 | Silvernail et al. | |
| 2016/0002576 | A1 | 1/2016 | Jones et al. | |
| 2016/0060579 | A1 | 3/2016 | Silvernail et al. | |
| 2016/0194582 | A1 * | 7/2016 | Olson | C11D 3/3707 510/220 |
| 2016/0340612 | A1 | 11/2016 | Kieffer et al. | |
| 2018/0010068 | A1 | 1/2018 | Roerdink Lander et al. | |
| 2018/0015509 | A1 | 1/2018 | Carter et al. | |
| 2018/0023037 | A1 | 1/2018 | Silvernail et al. | |

FOREIGN PATENT DOCUMENTS

| | | | |
|---|---|---|---|
| EP | 0364067 | A2 | 4/1990 |
| EP | 0469847 | A2 | 2/1992 |
| EP | 0561464 | A1 | 9/1993 |
| EP | 0659873 | A1 | 6/1995 |
| EP | 0851021 | A2 | 7/1998 |
| WO | 2010061239 | A1 | 6/2010 |
| WO | 2016112103 | A1 | 7/2016 |
| WO | 2016192787 | A1 | 12/2016 |

OTHER PUBLICATIONS

Rahman, Izuddin Abdul et al., "Formulation and Evaluation of an Automatic Dishwashing Detergent Containing T1 Lipase", J Surfact Deterg, vol. 16, pp. 427-434. Oct. 12, 2012.

Milojevic, Abstract, "Formulation and Evaluation of an Automatic Dischwashing Detergent Containing T1 Lipase", 2013.

International Searching Authority, PCT/US2018/039388, filing date Jun. 26, 2018, "The International Search Report and the Written Opinion of the International Searching Authority, or the Declaration", dated Sep. 26, 2018, 17 pages.

* cited by examiner

| | | | | | |
|---|---|---|---|---|---|
| | | | | | G |
| | | | | G | |
| | | | G | | |
| | | G | | | |
| | G | | | P | |
| G | | | | | |

FIG. 1

METHOD OF DISHWASHING COMPRISING DETERGENT COMPOSITIONS SUBSTANTIALLY FREE OF POLYCARBOXYLIC ACID POLYMERS

CROSS-REFERENCE TO RELATED APPLICATIONS

This application claims priority to provisional application U.S. Ser. No. 62/524,839 filed Jun. 26, 2017, which is incorporated herein by reference in its entirety.

FIELD OF THE INVENTION

Methods of dishwashing removing water conditioning agents, namely polycarboxylic acid polymers and phosphonates, from the detergent wash step are provided. The methods instead first employ a step of washing with an alkaline detergent that is substantially free of water conditioning agents comprising polycarboxylic acid polymers and phosphonates, followed by rinse step under high temperature with a water conditioning agent, namely polycarboxylic acid polymers and/or phosphonates. Beneficially, the methods result in little to no precipitation forming on the treated ware due to the treating of the hard water before it contacts the alkalinity source which prevents precipitation and/or flocculation from occurring.

BACKGROUND OF THE INVENTION

Dish machines have to effectively clean a variety of articles such as ware including for example glasses, pans, plates, bowls, and utensils. These articles include a variety of soils including protein, fat, starch and sugar. Dish machines remove soil by using a combination of detergents, rinse aids, temperatures, and/or mechanical action from water. In conventional washing process, a first step is a detergent wash step, followed by a rinse step. However, the introduction first of an alkaline detergent containing water conditioning polymers, followed by a rinse step often results in the untreated rinse water contacting residual alkalinity on the ware surface and causing the precipitation of hardness ions. Such precipitation results in the formation of undesirable inorganic film. This is commonly practiced when water conditioning agents, including polycarboxylic acid polymers are included in alkaline detergent compositions. This can often require a further processing step for the ware, such as an acid wash step to remove the film.

Accordingly, it is an objective to develop improved methods of dishwashing for removal of soils without causing precipitation or filming on the treated surfaces.

A further object is to an improved dishwashing method that reduces the overall consumption of water conditioning polymers.

A further object is to an improved dishwashing method that more efficiently uses polycarboxylic acid polymers in the rinse cycle to provide these desired benefits, namely controlling hard water scale and improving warewash cleaning performance.

BRIEF SUMMARY OF THE INVENTION

In an embodiment, methods of dishwashing include contacting ware with an alkaline detergent composition substantially free of water conditioning agents comprising, consisting of or consisting essentially of polycarboxylic acid polymers and/or phosphonates; and thereafter contacting ware with a rinse composition comprising the water conditioning agent(s). In a further aspect, the polycarboxylic acid polymer is a methacrylate polymer, an acrylate polymer, an acrylic maleic copolymer, a polymaleic acid homopolymer, an acrylate/ATBS copolymer or combinations thereof. In a further aspect, the detergent composition comprises less than about 0.5 wt-%, less than about 0.1 wt-% less than about 0.01 wt-%, and preferably 0 wt-% polycarboxylic acid polymer and/or phosphonate-. In a further aspect, the detergent compositions provide a pH of the composition of from about 9 to about 12.5 in an aqueous solution. In a further aspect, rinse compositions provide a pH of the composition from about 2 to about 8 in an aqueous solution. In a further aspect, the alkalinity detergent composition includes an inorganic alkalinity source. In an aspect, the rinse composition is free of polyitaconic acid polymers. In a further aspect, the methods of dishwashing including contacting ware with an alkaline detergent composition substantially free of water conditioning agents comprising, consisting of or consisting essentially of polycarboxylic acid polymers and/or phosphonates, and thereafter contacting ware with a rinse composition comprising the water conditioning agent(s), are suitable for dishwashing kitchen ware. In an aspect, the alkaline detergent wash step is applied at a temperature range from about 100° F. to about 180° F., and wherein the rinse step is applied at a temperature from about 100° F. to about 200° F. In an aspect, the rinse step does not result in precipitation on the treated ware. In an aspect, the water conditioning agent(s) in the rinse step provides at substantially similar cleaning performance of the ware while reducing the amount of the water conditioning agent(s) by at least about 25%, at least about 30%, at least about 40%, at least about 50%, at least about 60%, at least about 70%, or at least about 80% in comparison to conventional ware washing employing a water conditioning agent(s) in the wash step. In an aspect, the method further includes a sanitizing step after the rinse step. In an aspect, the rinse composition provides between about 0.5 ppm to about 40 ppm, between about 1 ppm to about 20 ppm, between about 5 ppm to about 20 ppm, between about 10 ppm to about 20 ppm, or between about 5 ppm to about 10 ppm of the polycarboxylic acid polymer and/or the phosphonate. In an aspect, the detergent comprises an alkalinity source and at least two components selected from the group consisting of water, a defoaming agent, a chelant(s) that is not a polycarboxylic acid polymer/phosphonate, an enzyme and a surfactant. In an aspect, the rinse composition further comprises at least one additional components selected from the group consisting of water, a defoaming agent, a sheeting agent, and a surfactant. In a further embodiment, a method of dishwashing includes contacting kitchen ware with an alkaline detergent composition substantially free of water conditioning agents comprising, consisting of or consisting essentially of polycarboxylic acid polymers and/or phosphonates, and thereafter contacting ware with a rinse composition comprising a polycarboxylic acid polymer and/or phosphonate, wherein the rinse composition is free of polyitaconic acid polymers, and wherein the method of dishwashing provides at least substantially similar (or an improvement in) scale inhibition and cleaning performance in comparison to a method employing the water conditioning agent(s), namely the polycarboxylic acid polymer, in the alkaline detergent composition. In an aspect, the detergent composition employed includes less than about 0.5 wt-%, less than about 0.1 wt-%, less than about 0.01 wt-%, and preferably 0 wt-% of the polycarboxylic acid polymer. In an aspect, the rinse composition comprises a polycarboxylic acid polymer and optionally a phosphonate. In another aspect, the rinse composition provides between about 0.5 ppm to about 40 ppm, between about 1 ppm to about 20 ppm, between about 5 ppm to about 20 ppm, between about 10 ppm to about 20 ppm, or between about 5 ppm to about 10 ppm of the polycarboxylic acid polymer and/or the phosphonate.

In an aspect, the polycarboxylic acid polymer in the rinse step reduces the amount of the polymer by at least about 25%, at least about 30%, at least about 40%, at least about 50%, at least about 60%, at least about 70%, or at least about 80% in comparison to conventional ware washing employing the polymer in the wash step while providing at least substantially similar cleaning performance. In an aspect, the detergent comprises an alkalinity source and at least two components selected from the group consisting of water, a defoaming agent, a chelants that is not a polycarboxylic acid polymer/phosphonate, an enzyme and a surfactant. In an aspect, the rinse composition further comprises at least one additional components selected from the group consisting of water, a defoaming agent, a sheeting agent, and a surfactant. In an aspect, the method further comprises a sanitizing step after the rinse step. In an aspect, the detergent compositions provides a pH of the composition of from about 9 to about 12.5 in an aqueous solution. In an aspect, the rinse compositions provides a pH of the composition from about 2 to about 8 in an aqueous solution.

In a further embodiment, a warewashing system comprises: an alkaline detergent composition substantially free of polycarboxylic acid polymer and/or phosphonate; and a rinse composition comprising a polycarboxylic acid polymer and/or a phosphonate, wherein the alkaline detergent composition and thereafter rinse composition are dosed in a warewash machine. In an aspect, the system provides at least substantially similar (or an improvement in) scale inhibition and cleaning performance while reducing by at least about 25%, at least about 30%, at least about 40%, at least about 50%, at least about 60%, at least about 70%, or at least about 80% in overall consumption of the polycarboxylic acid polymer in the warewashing system compared to a system employing the polymer in the detergent step.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 1 shows the arrangement of glasses in the Raburn rack as evaluated in the Examples.

Figure 2:
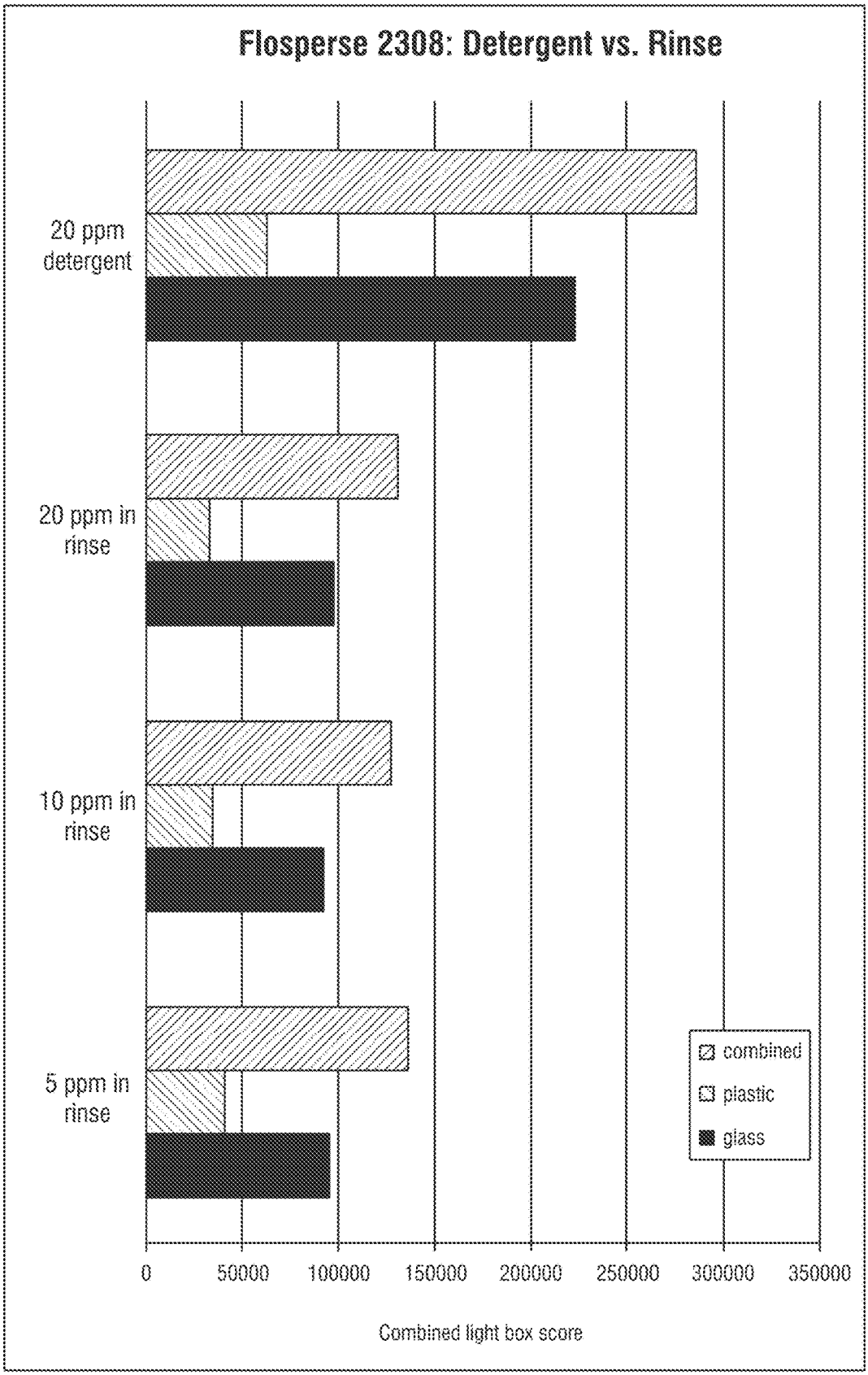
FIG. 2 shows light box evaluation scores for the commercially-available water conditioning agent Flosperse 2308 provided in a detergent composition compared to varying concentrations in the rinse aid composition.

Various embodiments will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

Methods of dishwashing employing a rinse step containing water conditioning agents, including a polycarboxylic acid polymer and optionally a phosphonate, namely such step following an alkaline detergent wash step that is substantially free of any such water conditioning agents are provided. The methods of use have many advantages over conventional ware washing methods utilizing water conditioning agents in the wash step, including at least substantially similar (or an improvement in) scale inhibition and cleaning performance for the warewashing system (detergent wash and rinse aid), and reduction in overall consumption of the agents, namely the polycarboxylic acid polymer, in the warewashing system. The embodiments are not limited to particular warewashing compositions and/or methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%. In an aspect, the detergent compositions employed in the warewashing methods are substantially free of polycarboxylic acid polymer and/or phosphonate. In further aspects, the detergent compositions are free of polycarboxylic acid polymer and/or phosphonate wherein the detergent compositions have 0 wt-% polycarboxylic acid polymer and/or phosphonate.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both. In an aspect, the warewashing methods employing the polycarboxylic acid polymer in the rinse step (including at a reduced actives level) as opposed to a detergent wash step provide at least substantially similar cleaning performance. In other aspects, the warewashing methods disclosed herein provide enhanced or superior cleaning performance and/or scale inhibition.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions include but are not limited to, those that include polycarbonate polymers (PC), acrylonitrile-butadiene-styrene polymers (ABS), and polysulfone polymers (PS). Another exemplary plastic that can be cleaned using the compounds and compositions include polyethylene terephthalate (PET).

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions may comprise, consist essentially of, or consist of the component and ingredients as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Methods Employing the Polycarboxylic Acid Polymers in Warewashing

The disclosure generally relates to rinse compositions and methods of using the same for warewashing and other cleaning methods. The methods beneficially result in at least substantially similar (or improved) scale inhibition and cleaning performance, and reduction in overall consumption of polycarboxylic acid polymers in a warewashing system compared to a system employing the polymer in the detergent step. These benefits are provided as a result of the methods and the system employing first an alkaline detergent composition substantially free of polycarboxylic acid polymers, followed by a rinse composition comprising a polycarboxylic acid polymer. The methods further beneficially result in a reduction of the amount of polycarboxylic acid polymers employed in a warewash method and/or system. In some embodiments, there is at least a 50% reduction in polycarboxylic acid polymer compared to a conventional warewash method employing the polymer in a detergent wash. In further embodiments, there is at least about 25% reduction, at least about 30% reduction, at least about 40% reduction, at least about 50% reduction, at least a 60% reduction, at least a 70% reduction, at least an 80% reduction, or at least an 85% reduction in polycarboxylic acid polymer compared to a conventional warewash method employing the polymer in a detergent wash.

Without being limited to a particular mechanism of action, the removal of the polycarboxylic acid polymer from the detergent wash step and placing the polymer in the rinse step beneficially results in little to no precipitation forming as the rinse water (often at elevated temperatures, such as at least 180° F.) is treated with the polycarboxylic acid polymer prior to contacting the ware and any residual alkalinity. The disclosure includes methods of warewashing using the rinse compositions comprising a polycarboxylic acid polymer and/or phosphonate. In some embodiments, the methods include applying the rinse compositions comprising a polycarboxylic acid polymer and/or phosphonate directly to an article to be rinsed after an initial cleaning wash step with an alkaline detergent. In an aspect, the alkaline detergent is substantially-free of polycarboxylic acid polymers and/or phosphonate.

According to embodiments, the applying of the detergent composition and thereafter the rinse composition may be applied to the article to be cleaned by spraying the composition through either the wash arm or the rinse arm of the dishmachine, or by spraying the composition through an additional spray arm or through spray nozzles. A variety of cleaning and rinsing processes are known, including Avram, U.S. Pat. No. 5,879,469, which teaches a warewashing system using a basic aqueous wash followed by an acidic aqueous wash. Howland et al., U.S. Pat. No. 5,448,115, shows that aqueous rinse cycles can be effectively controlled to modify dispensing and timing of cleaning chemicals. Young, Jr. et al., U.S. Pat. No. 5,429,679, shows further control systems and in particular directing rinse water recycle into other washing cycle steps. Steindorf, U.S. Pat. No. 5,447,648, and Baum, U.S. Pat. No. 5,589,099, disclose solid food grade rinse aid compositions and improved synthetic ethylene oxide propylene oxide block copolymer based rinse aids. Groult et al., U.S. Pat. No. 4,501,681, show at Column 8, lines 35-55 and elsewhere, the use of multiple rinse steps. Groult et al. show a process involving a first and second rinse step using rinse water followed by a third rinse step using acid or neutral rinsing agents. Jones et al., U.S. Pat. No. 5,232,622, show two sequential rinse steps (Column 6, lines 49-64). Jones et al. disclose nothing regarding the compositions used in the rinse cycles, however, the cycles likely contain conventional synthetic alkaline oxide based rinse agents.

Warewashing Machines

The disclosed methods may be carried out in any consumer or institutional dish machine. Warewashing machines can include wash water solutions at high temperature (temperature sanitizing) or low temperature (chemical sanitizing) in both institutional and house-hold automatic warewashing machines. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

The simplest machines are typically machines operating at low temperature (less than 160° F.) having a single tank for aqueous materials used in the wash cycle. Such low temperature machines typically use a washing cycle that uses a washing solution prepared from an alkaline detergent composition. Once the short washing cycle is complete, the washing liquid is typically dumped from the machine and the ware is rinsed using a rinse cycle. The rinse water is typically maintained in the machine for reuse in the next wash cycle. To create a proper wash water material, additional detergent is typically dispensed into the water to restore the appropriate concentration of the washing ingredient components. After the wash and rinsing cycles are complete, the ware can optionally be contacted with the sanitizer material to ensure complete safety. Larger multi-station high temperature machines (greater than about 160° C.) are also used in locations having a higher volume of ware cleaning. Such machines typically involve a conveyor system in which individual racks of ware are moved through the multistation machine for a complete washing regimen. Often such ware racks are prescrubbed to remove large gross soils in a prewasher/prescrape stage, the ware is contacted with water under pressure to remove all large food items prior to washing. In the large rack conveyor systems, the ware and rack are typically exposed to a prewash stage, a power wash stage, a power rinse stage, a final rinse stage and can be exposed to a blow dryer to complete the production of a clean dry dish. Prewash stage is often involved contacting the ware with aqueous streams containing moderate amounts of cleaner materials to clean or prepare soils for removal. In a power wash stage, the ware is contacted with aqueous detergents containing effective concentrations of alkaline materials, surfactants and other components to completely remove the soils and prepare for the power wash stage in the prewash stage. The ware is then often directed to a power rinse stage and a final rinse stage. In these rinse stages, the alkaline detergent materials are rinsed from the dishes and if necessary, the ware can be exposed to a sanitizer rinse. In order to ensure that no confusion results from the discussion of the warewashing machines, simple dump and fill, single zone dishwashers can be operated at both high and low temperature.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms. Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The disclosed methods may also be used in a pot and pan washer, a utensil washer, glasswashers and/or a conveyor machine. A conveyor machine refers to a commercial dish machine, wherein the soiled dishes are placed on a rack that moves through a dish machine on a conveyor. A conveyor machine continuously cleans racks of soiled dishes instead of one rack at a time. Here the manifolds are typically stationary or oscillating and the rack moves through the machine. A conveyor machine may be a single tank or multi-tank machine. The conveyor machine may include a prewash section. A conveyor machine may be a high temperature or low temperature machine. Finally, conveyor machines primarily recirculate the detergent solution. Some non-limiting examples of conveyor machines include the Ecolab ES-4400, the Jackson AJ-100, the Stero SCT-44, and the Hobart C-44, and C-66.

The disclosed methods may also be used in an undercounter machine. An undercounter machine refers to a dish machine similar to most consumer dish machines, wherein the dish machine is located underneath a counter and the dishes are cleaned one rack at a time. In an undercounter dish machine, the rack is stationary and the wash/rinse arms are moving. Undercounter machines may be a high temperature or low temperature machine. The undercounter machine may either be a recirculation machine or a dump and fill machine. Some non-limiting examples of undercounter machines include the Ecolab ES-1000, the Jackson JP-24, and the Hobart LX-40H.

The disclosed methods may also be used in a flight machine. A flight machine refers to a commercial dish machine, wherein the soiled dishes are placed on pegs that move through a dish machine on a conveyor. A flight machine continuously cleans soiled dishes and racks are not used. Here the manifolds are typically stationary or oscillating and the conveyor moves through the machine. A flight machine is typically a multi-tank machine. The flight machine may include a prewash section. A flight machine is typically a high temperature machine. Finally, flight machines typically recirculate the detergent solution. Some non-limiting examples of flight machines include the Meiko BA Series and the Hobart FT-900.

Use of the various described dish machines will also employ a dispenser for dispensing the detergent compositions, rinse compositions and optionally sanitizing compositions. The dispenser may be selected from a variety of dispensers depending on the physical form of the composition. For example, a liquid composition may be dispensed using a pump, either peristaltic or bellows for example, syringe/plunger injection, gravity feed, siphon feed, aspirators, unit dose, for example using a water-soluble packet such as polyvinyl alcohol or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example, using a water-soluble packet such as polyvinyl alcohol or a foil pouch, evacuation from a pressurized chamber, or diffusion through a membrane or permeable surface. The dispenser may also be a dual dispenser in which the stabilized enzyme composition is dispensed on one side, and the surfactant composition is dispensed on the other side. These dispensers may be located in the dish machine, outside of the dish machine, or remote from the dish machine. Finally, a single dispenser may feed one or more dish machines.

It is understood that the dish machines described herein may be used in conjunction with the disclosed methods. Additionally, the dish machines may be modified as described and used with a different method of cleaning. For example, instead of using the methods in a modified dish machine, a different detergent, for example, a special surfactant package, rinse aid, or the like, may be run through the modified dish machine, for example through the additional wash or rinse arms, or spray nozzles.

Detergent Compositions

Detergent compositions employed according to the methods and systems are alkaline detergents substantially free of water conditioning agents, wherein the water conditioning agent comprises, consists of or consists essentially of polycarboxylic acid polymers and/or phosphonate. The term "water conditioning agent" does not include chelants, builders or sequestering agents which can be included in the detergent compositions.

The detergents can be in the form of a thickened liquid, particulate solid, a pellet, aqueous solution or dispersion or in the form of a solid block detergent. In institutional warewashing, such particulate, pellet or solid block detergents are dispensed using an automatic dispenser that creates an aqueous concentrate (i.e.) an aqueous solution or suspension of the alkaline detergent using a water spray. The water spray dissolves a portion of the detergent when needed to for the aqueous concentrate. The aqueous concentrate is directed into a washing chamber in the automatic warewashing machine for a wash cycle. Such detergents have been based on a variety of sources of alkalinity including alkali metal hydroxide, alkali metal silicate, alkali metal carbonate or bicarbonate, etc.

In order to provide an alkaline pH, the composition comprises an alkalinity source. Generally, the alkalinity source raises the pH of the composition at use to at least 10.0 in an aqueous solution and generally to a range of from about 9.0 to 12.5, preferably from about 10.5 to 12.5, and most preferably from about 11.0 to 12.5. This higher pH increases the efficacy of the soil removal and sediment breakdown when the chemical is placed in use and further facilitates the rapid dispersion of soils. The general character of the alkalinity source is limited only to those chemical compositions which have a greater solubility. That is, the alkalinity source should not contribute metal ions which promote the formation of precipitates or film salts. Exemplary alkalinity sources are alkali metal carbonate and bicarbonate compositions. The major source of inorganic alkalinity and inorganic detergency resides with the sodium or potassium carbonate or bicarbonate detergent materials. These materials are preferred because they have sufficient detergency to clean ware in the warewashing machines but also are easily rinsed. The alkali metal carbonates which may be used in the methods and compositions include sodium carbonate, potassium carbonate, sodium or potassium bicarbonate, among others. The preferred alkalinity source is sodium carbonate also known as soda ash. Carbonates are used in the composition at a proportion of about 25 to 85 wt %, or about 25 to 50 wt % and most preferably about 25 to 40 wt %.

The major source of inorganic alkalinity and inorganic detergency resides with the sodium or potassium carbonate or bicarbonate detergent materials. These materials are preferred because they have sufficient detergency to clean ware in the warewashing machines but also are easily rinsed. In addition, or alternatively, alkali metal hydroxides, silicates or other stronger alkaline detergents can also be employed.

The detergent compositions can optionally include components to treat or soften water and to prevent the formation of precipitates or other salts, the composition generally comprises builders, sequestrants, chelating agents or solidifying agents.

A builder is typically a material that enhances or maintains the cleaning efficiency of a detergent composition. Several types of compounds with different performance capabilities are used. Builders have a number of functions, principally inactivation of water hardness accomplished by sequestration or by ion exchange. Complex phosphates are common sequestrant builders. Sodium aluminum silicate is an ion exchange builder. Another function of builders are to supply alkalinity to a detergent formulation, especially for cleaning acid soils, to provide buffering to maintain alkalinity at an effective level to and in keeping removed soil from redepositing during washing into emulsified oil and greasy soils. Detergent builders are well understood materials, commonly available for use in these aqueous warewashing detergents. Generally, sequestrants are those molecules capable of coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), triden-tate (3), tetradentate (4), etc. Any number of sequestrants may be used. According to embodiments of the methods and compositions, the builders and sequestrants do not include polycarboxylic acid polymers.

The detergent compositions can also comprise a solidifying agent when used in solid block product format. Particularly desirable as solidifying agents are those which are solid at room temperature and have an inherently reduced aqueous solubility as a result of the combination with the coupling agent. Generally, any agent or combination of agents which provides a requisite degree of solidification and aqueous solubility may be used. A solidification agent may be selected from any organic or inorganic compound which imparts a solid char-acter and/or controls the soluble character of the present composition when placed in an aqueous environment.

The detergent composition can further comprise a surfactant, chelant (or builder) and/or additional antimicrobial agents. Still further additional optional functional ingredients can be employed in the detergent compositions as will he appreciated by skilled artisans.

In an aspect the detergent composition contains a chelant (also referred to as building agents, chelating or sequestering agents), including, but not limited to: condensed phosphates, alkali metal carbonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferred chelating agents include ethylenediaminetetraacetic acid (EDTA); diethylenetriaminepentacetic acid (DTPA); methylglycine-N,N-diacetic acid (MGDA); glutamic acid-N,N-diacetic acid (GLDA); Aspartic acid-N,N-diacetic acid (ASDA) and alkali, alkali earth metal, transition metal and/or ammonium salts thereof.

Rinse Compositions

Rinse compositions employed according to the methods provide a polycarboxylic acid polymer and/or phosphonate for enhanced rinsing of ware without the precipitation and formation of inorganic film on the treated water. The rinse composition can be in the form of a thickened liquid, particulate solid, a pellet, aqueous solution or dispersion or in the form of a solid block. Beneficially, rinse compositions are optimized to provide rinsing properties that have relatively reduced surface tension, improved soil removing properties and/or other properties common to nonionic materials in general. A conventional rinse agent is typically formulated as a concentrate in liquid or solid form which is diluted with water in a rinse aid dispenser to form an aqueous rinse composition used in a warewashing machine rinse cycle to ensure that dishes sheet cleanly.

In an aspect, the rinse compositions in an aqueous solution have a pH from about 2 to about 8, including all ranges therein.

In an aspect, the rinse composition provides between about 0.01 wt-% to about 20 wt-% of the polycarboxylic acid polymer in a rinse composition. In further preferred aspects, the rinse composition provides between about 0.1 wt-% to about 20 wt-% of the polycarboxylic acid polymer in a rinse composition, between about 0.1 wt-% to about 10 wt-% of the polycarboxylic acid polymer in a rinse composition, between about 0.1 wt-% to about 8 wt-%, between about 1 wt-% to about 8 wt-%, between about 1 wt-% to about 7 wt-%, between about 1 wt-% to about 6 wt-%, between about 1 wt-% to about 5 wt-%, between about 1 wt-% to about 4 wt-%, and any ranges therein.

In an aspect, the rinse composition provides in an aqueous use solution in a warewash machine between about 0.5 ppm to about 40 ppm of the polycarboxylic acid polymer and/or phosphonate. In further preferred aspects, the rinse composition provides in an aqueous use solution in a warewash machine between about 0.5 ppm to about 20 ppm of the polycarboxylic acid polymer and/or phosphonate, between about 1 ppm to about 20 ppm of the polycarboxylic acid polymer and/or phosphonate, between about 5 ppm to about 20 ppm of the polycarboxylic acid polymer and/or phosphonate, between about 10 ppm to about 20 ppm of the polycarboxylic acid polymer and/or phosphonate, or between about 5 ppm to about 10 ppm of the polycarboxylic acid polymer and/or phosphonate.

The rinse compositions include a polycarboxylic acid polymer. Representative polycarboxylic acid polymers suitable for the rinse composition include amino carboxylic acids, water soluble acrylic polymers, polymaleic homopolymers, maleic polymers, among others to condition the rinse solutions under end use conditions. Such polymers include polyacrylic acid, poly-methacrylic acid, acrylic acid-methacrylic acid copolymers, hydrolyzed polyacrylamide, hydrolyzed methacrylamide, hydrolyzed acrylamide-methacrylamide copolymers, hydro-lyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used.

In addition, phosphonic acid salts or phosphonate sequestrants may also be employed. In some embodiments, the phosphonic acid salts and/or phosphonate sequestrants may be employed alone, without the polycarboxylic acid polymers. Such useful phosphonic acids include, mono, di, tri and tetraphos-phonic acids which can also contain groups capable of forming anions under alkaline conditions such as carboxy, hydroxy, thio and the like.

In an embodiment, the rinse compositions are free of polyitaconic acid polymers.

The rinse compositions can further include additional complexing or chelating agent that aids in reducing the harmful effects of hardness components in service water. Typically, calcium, magnesium, iron, manganese, and other polyvalent metal cations present in service water, can interfere with the action of either washing compositions or rinsing compositions. A chelating agent can effectively complex with and prevent such ions from the service water interfering with the action of an active component increasing rinse agent performance. Both organic and inorganic chelating agents are common. Inorganic chelating agents include such compounds as sodium pyrophosphate, and sodium tripolyphosphate while organic chelating agents include both polymeric and small molecule chelating agents. Polymeric chelating agents commonly comprise ionomer compositions such as polyacrylic acids compounds. Small molecule organic chelating agents include salts of ethylenediaminetetracetic acid (EDTA) and hydroxyethylene-diaminetetracetic acid, nitrilotriacetic acid, ethylenediaminetetrapropionates, triethylene-tetraminehexacetates, and the respective alkali metal ammonium and substituted ammonium salts thereof. Amino phosphates are also suitable for use as chelating agents in the compositions and include ethylenediamine tetra(methylene-phosphonate), nitrilotrismethylenephosphonate, diethylenetriaminepenta(methylene phosphonates). These amino phosphonates commonly contain alkyl or alkylene groups with less than 8 carbon atoms. Suitable amino carboxylic acid chelating agents include N-hydroxyethyliminodiacetic acid, nitrilotriacetic acid (NTA), ethylenediaminetetraacetic acid (EDTA), N-hydroxyethyl ethylenediaminetriacetic acid (HEDTA), and dimethylenetriaminepentaacetic acid (DTPA). Particularly well suited chelating agents include ethylenediaminetetraacetic acid (EDTA); diethylenetriaminepentaacetic acid (DTPA); methylglycine diacetic acid (MGDA), glutamic acid-N,N-diacetic acid (GLDA) aspartic acid-N,N-diacetic acid (ASDA) and alkali metal and/or ammonium salts thereof. When used, these amino carboxylic acids are generally present in concentrations ranging from about 1 wt % to 25 wt %.

The rinse compositions can further include nonionic surfactants. The rinse compositions can further include synthetic polymeric compositions comprising at least a block of ethylene oxide in combination with other moieties in the composition to result in an aqueous composition that can cause the rapid sheeting of the rinse water from ware for the intended purpose of leaving a bright, clean, unspotted product. Typical useful rinse agents are the poly (lower alkylene oxide) polymers that are usually prepared by the condensation of lower (2-4 carbon atoms) alkylene oxide monomer(s) that have rinsing or sheeting activity. For example, ethylene oxide or propylene oxide (with enough ethylene oxide to make a water soluble or dispersible product), can be condensed with a compound having a hydrophobic hydrocarbon chain and containing one or more active hydrogen atoms such as a higher alkyl phenol, higher fatty acids, higher fatty amines, higher fatty polyols and alcohols and in some cases higher fatty mercaptans. Such compounds include fatty alcohols having 8-20 carbon atoms in an alkyl or aliphatic chain, an alkoxylate (preferably ethoxylate) with an average of about 1 to 100 lower alkylene oxide moieties.

Additional optional rinse agents comprise nonionic materials that fall within a number of well understood molecular classes including polyoxyethylene (ethoxylate) surfactants, carboxylic acid ester surfactants, carboxylic acid amide surfactants, hydrophobically substituted oxyalkylene surfactants and polyalkylene oxide block copolymers. All nonionic rinse agents typically have at least one block segment comprising (AOL-, wherein AO represents an oxyalkylene moiety and x is a number of about 1 to about 100. Preferably, AO represents either an ethylene oxide moiety or a propylene oxide moiety. A homopolymer polyethylene oxide or a homopolymer polypropylene oxide have little or no surfactant properties. The (AOL-block must be attached to a functional group differing in hydrophilicity (or hydrophobicity) to obtain rinsing or sheeting properties. A number of polyethoxy substituted surfactants are known including ethoxylated aliphatic alcohols, ethoxylated alkylphenols, ethoxylated carboxylic acid and carboxylic acid esters, ethoxylated fatty acid amides and others. Such surfactants can be manufactured in a low foaming rinse agent active form. Preferred rinse agent comprises a polyalkylene oxide block copolymer. Such copolymers are derived from higher alkylene oxides such as ethylene oxide, propylene oxide, butylene oxide, styrene oxide, etc. Such block copolymers typically contain a polyethylene oxide block which is relatively hydrophilic combined with another polyalkylene oxide block which is typically hydrophobic resulting in surfactant properties. Preferred surfactants include those surfactants that can remove proteinaceous and greasy soil in combination with rinsing capability. Preferred surfactants are low foaming surfactants that obtain grease removal and rinse aid properties.

Certain types of polyoxypropylene-polyoxyethylene block copolymer surfactants have also been found to be particularly useful. Those surfactants comprising a center block of polyoxypropylene units (PO), and having a block of polyxyethylene (EO) units to each side of the center PO block, are generally useful, particularly where the average molecular weight ranges from about 900 to 14,000, and the percent of weight EO ranges from about 10 to 80. Similarly, reverse PO-EO-PO polymers and block copolymers are also suitable for use. These types of surfactants are sold commercially as "Pluronics" by the BASF Wyandotte Corporation, and are available under other trademarks from other chemical suppliers.

The rinse composition may optionally include a liquid carrier. The liquid rinse agents can have a liquid base component which functions as a carrier and cooperates with aqueous diluents to form the aqueous rinse. Liquid bases are preferably water or a solvent compatible with water to obtain compatible mixtures thereof. Exemplary nonlimiting solvents in addition to water include a low molecular weight $C_{1-6}$ primary and secondary mono, di- and tri-hydroxy alcohol such as methanol, ethanol, isopropanol, and polyols containing from two to six carbon atoms and from two to six hydroxyl groups such as propylene glycol, ethylene glycol, glycerine, propane diol, propylene glycol, etc.

The organic nature of the rinse agents can be subject to microbial and chemical decomposition. Organic materials are commonly useful in stabilizing the mixtures. Preferred preservatives or stabilizers include food grade stabilizers, food grade antioxidants, etc. Most preferred materials for use in stabilizing the compositions include $C_{1-10}$ mono, di- and tricarboxylic acid compounds. Preferred examples of such acids include acetic acid, citric acid, benzoic, sorbic, lactic, maleic, tartaric and fumaric. Optional ingredients which can be included in the rinse agents in conventional levels for use include solvents, hydrotropes, processing aids, corrosion inhibitors, dyes, fillers, optical brighteners, germicides, pH adjusting agents (monoethanolamine, sodium carbonate, sodium hydroxide, hydrochloric acid, phosphoric acid, et cetera), bleaches, bleach activators, perfumes and the like. Still further additional optional functional ingredients can be employed in the rinse compositions as will be appreciated by skilled artisans.

Surfactants

The detergent compositions and/or rinse compositions may include surfactants to provide enhanced cleaning performance. Additional detergency or cleaning efficacy for the compositions can be obtained from the use of surfactant materials. Various types of surfactants may be formulated into the compositions. Surfactants suitable for use with the compositions include, but are not limited to, anionic surfactants, nonionic surfactants, amphoteric surfactants and/or zwitterionic surfactants.

In some embodiments, the compositions employed in the methods, both detergent compositions and rinse compositions, can include about 0.001 wt-% to about 70 wt-% of surfactants, or about 0.01 wt-% to about 50 wt-% of surfactants. In other embodiments, the compositions include about 1 wt-% to about 30 wt-% of surfactant, preferably about 1 wt-% to about 20 wt-% of surfactant.

Anionic Surfactants

In some embodiments, the compositions include an additional surfactant that is an anionic surfactant. Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

In additional aspect, aromatic sulfonate materials such as alkyl benzene sulfonate, xylene sulfonates, naphthalene sulfonate, dialkyldiphenyl oxide sulfonate materials, and cumene sulfonates are particularly suited for use in the rinse aid compositions.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like. Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

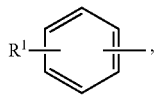

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

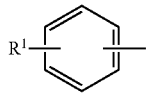

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Nonionic Surfactants

In some embodiments, the compositions include an additional surfactant that is a nonionic surfactant. Suitable nonionic surfactants suitable for use with the compositions include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R-(EO)_5(PO)_4$) and Dehypon LS-36 ($R-(EO)_3(PO)_6$); and capped alcohol alkoxylates, such as Plurafac LF221 and Tegoten EC11; mixtures thereof, or the like.

The semi-polar type of nonionic surface active agents is another class of nonionic surfactant useful in compositions. Semi-polar nonionic surfactants include the amine oxides, phosphine oxides, sulfoxides and their alkoxylated derivatives.

Amine oxides are tertiary amine oxides corresponding to the general formula:

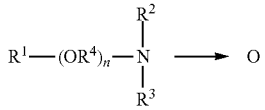

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof. $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Amphoteric Surfactants

In some embodiments, the compositions include an amphoteric surfactant. Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application generally have the general formula:

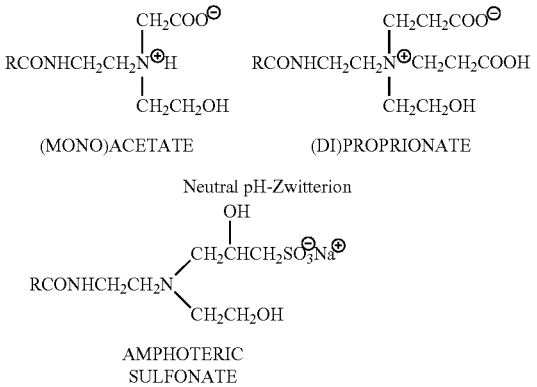

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

In some embodiments, the compositions include an additional surfactant that is a zwitterionic surfactant. Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

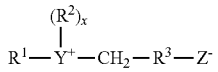

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

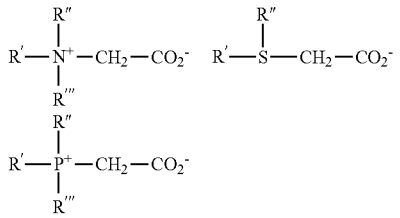

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines include those compounds having the formula $(R(R^1)_2N^+ R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Sanitizing Compositions

In the event a sanitizing step is employed according to the methods and systems of, biocides can be used in a sanitizing step. Biocides are antimicrobial agents or chemical compositions that can prevent microbiological contamination or deterioration caused by microorganisms. Most useful antimicrobial agents comprise phenolics, halogen compounds, quaternary ammonium compounds, amines, alkanol amines, nitro compounds and a variety of miscellaneous types of antimicrobial agents. Antimicrobial agents operate by either interfering with a cellular mechanism or a cellular component of the microbe resulting in the substantial reduction of microbial populations or simply prevent proliferation in numbers of microorganisms that would prevent the accumulation of harmful numbers of microorganisms. Antimicrobial agents are often effective against one or more of typical microbial classifications such as gram positive, gram negative, fungi, molds and yeasts.

Preferred antimicrobial agents used to kill or reduce microbial populations requires physical and chemical compatibility with the system, stability and resistance to be inactivated by other components or ingredients in this system, stability under use and storage conditions of pH temperature and light exposure while being safe and essentially non-toxic to humans in handling formulation and use. Typical antimicrobial agents are used in aqueous solution at a concentration of about 0.1 to 1000 ppm, preferably about 1 to 200 ppm and are simply contacted with the ware in a separate step or as a component of the post detergent rinse or the final aqueous rinse step.

Additional Functional Ingredients

The compositions disclosed herein can include a number of additional functional ingredients. For the purpose of this application, the term "functional materials or ingredients" include a material that when dispersed or dissolved in a use and/or concentrate solution, provides a beneficial property in a particular use. Functional ingredients which may be employed in the detergent and/or rinse compositions include, for example, any combination of sources of acid or alkalinity, enzymes, surfactants, defoamers, additional water conditioning agents or rinse aids, including food grad rinse agents, chelants, additional antimicrobial agents, preservatives, viscosity modifiers, bleaching agents, dyes and fragrances, and the like.

The compositions may be a variety of liquids, including for example, thickened liquid, gelled liquid, paste, or the like. Liquid compositions can typically be made by forming the ingredients in an aqueous liquid or solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible solvent including a gelling agent at an appropriate concentration. The composition is preferably a liquid ready-to-use composition. A concentrate refers to a composition that is diluted to form a ready-to-use composition. A ready-to-use composition refers to a composition that is applied to the surface to be cleaned.

Alternatively, the detergent and/or rinse compositions can be provided as solid compositions. Both the liquid and solid compositions may be provided in bulk or in unit dose. For example, the compositions may be provided in a large block compositions that may be used for many cleaning cycles. Alternatively, the composition may be provided in unit dose form wherein a new composition is provided for each new cleaning cycle. The compositions may be packaged in a variety of materials, including a water soluble film, disposable plastic container, flexible bag, shrink wrap and the like.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The following Examples provide exemplary embodiments of the warewashing system that includes a detergent and rinse aid and shows improved scale inhibition and cleaning performance.

The following materials were employed:

Flosperse 2308—Acrylic maleic copolymer available from SNF Holding Company;

Alcosperse 125—methacrylate polymer available from Akzo Nobel Surfactants, Chicago, Ill.;

Alcoguard H5853—Starch/acrylic acid hybrid polymer available from Akzo Nobel;

Belclene 200—polymaleic acid homopolymer available from BWA Water Additives; and Acumer 2000—Acrylate/ATBS copolymer available from Dow Chemical Company.

Example 1

In this Example, control detergent compositions containing conventional polycarboxylic acid polymers were evaluated for their glass and plastic film accumulation in an institutional dish wash machine by a hard water film accumulation test.

A hard water film accumulation testing was conducted using a light box evaluation of glasses after 100 wash or wash/rinse cycles. The 100 wash or wash/rinse cycles were performed by a Hobart AM-15 dish wash machine employing 17 grains per gallon (gpg) water (hard water source) and using six 10 oz. Libby glasses. The Hobart AM-15 dish wash machine has a wash bath volume of 53 L. For the tests, each cycle uses a rinse volume of 2.8 L, 50 second wash time, and optionally 9 second rinse time.

Initially the 6 glasses were prepared using a cleaning cycle to completely remove all film and foreign material from the glass surface. The detailed procedure to clean these 6 glasses is the following: Fill glass rack with dirty glasses and load in dish machine. Fill dish machine with hot soft water (130° F. minimum). Add Lime-A-Way. Close door to start an automatic cycle. When cycle is complete, drain and refill the machine with fresh hot water. Run another automatic cycle. Drain and refill the machine. Add Guardian Plus and run yet another automatic cycle. Drain and refill the machine and repeat twice the automatic cycle and refill again. Drain the machine and fill the machine with distilled water. Run the machine in a delime mode with the distilled water for 3 minutes. Allow glassed to dry in rack prior to use For the 100 cycles test, the dish machine is run in a wash or wash/rinse cycle with a wash temperature of 150-160° F. and rinse temperature of 175-190° F. During the test, the 6 glasses is arranged in the Raburn rack in a pattern shown in FIG. 1 (G=glass tumblers).

At the beginning of each wash cycle, the appropriate amount of the detergent to be evaluated is automatically dispensed into the dish machine. Detergent concentration is controlled by conductivity. At the beginning of each rinse, an appropriated amount of the rinse aid composition to be evaluated is also dispensed into the dish machine.

After 100 cycles of wash/rinse are finished, the glasses were dried overnight and then the film accumulation using a strong light source was evaluated.

The light box test standardizes the evaluation of the glasses used in the 100 cycle test. The light box test is based on the use of an optical system including a photographic camera, a light box, a light source and a light meter. The system is controlled by a computer program (Spot Advance and Image Pro Plus).

To evaluate the glasses after the 100 cycle test, each glass was placed on the light box resting on its side and the intensity of the light source was adjusted to a predetermined value using a light meter. The conditions of the 100 cycle test were entered into the computer. A picture of the glass was taken with the camera and saved on the computer for analysis by the program. The picture was analyzed using the upper half of the glass to avoid the gradient of darkness on the film from the top of the glass to the bottom of the glass, based on the shape of the glass.

Generally, a lower light box rating indicates that more light could pass through the glass. Thus, the lower the light box rating, the more effective the composition was at preventing scaling on the surface of the glass. Light box evaluation of a clean, unused glass has a light box score of approximately 12,000 which corresponds to a score of 72,000 for the sum of 6 glasses.

In this Example, detergent compositions with or without a water conditioning polymer were evaluated for their hard water film accumulation in 100 cycles. Table 1 lists the compositions of the detergents evaluated in this Example. The detergents were supplied at 1,000 ppm in the wash solutions and no rinse aid was used.

TABLE 1

Various Exemplary Compositions of Control Detergents with a Water Conditioning Polymer

| | Detergent #1 | Detergent #2 | Detergent #3 | Detergent #4 | Detergent #5 |
|---|---|---|---|---|---|
| Dense Ash | 75 | 75 | 75 | 75 | 75 |
| D1 Water | 25 | 20.83 | 20.56 | 21 | 20.35 |
| Flosperse 2308 (Acrylic maleic copolymer), 48% | 0 | 4.14 | 0 | 0 | 0 |
| Alcoguard 5853 (Starch/acrylic acid hybrid polymer), 45% | 0 | 0 | 4.44 | 0 | 0 |
| Belclene 200 (polymaleic acid homopolymer) 50% | 0 | 0 | 0 | 4 | 0 |
| Acumer 2000 (Acrylate/ATBS copolymer), 43% | 0 | 0 | 0 | 0 | 4.65 |
| Total | 100 | 100 | 100 | 100 | 100 |

Table 2 shows the light box scores for the glasses and plastic after 100 cycles of washing using the detergents containing the water conditioning polymers listed in Table 1.

TABLE 2

Light Box Scores of the Glasses after 100 Cycles of Wash using the Detergent with or without a Polymer.

| | Polymer | Polymer Concentration in Detergent (ppm) | Polymer in Rinse Aid (ppm) | Light Box Scores Glasses | Plastic | Total |
|---|---|---|---|---|---|---|
| #1 | none | 0 | 0 | 393210 | 65535 | 458745 |
| #2 | Flosperse 2308 (Acrylic maleic copolymer) | 20 | 0 | 223120 | 62951 | 286071 |
| #3 | Alcoguard 5853 (Starch/acrylic acid hybrid polymer) | 20 | 0 | 221659 | 44914 | 286071 |
| #4 | Belclene 200 (polymaleic acid homo-polymer) | 20 | 0 | 156884 | 40687 | 266571 |
| #5 | Acumer 2000 (Acrylate/ATBS copolymer) | 20 | 0 | 184543 | 65535 | 250078 |

The results in Table 2 show clearly that the polymer used in the detergent (Detergents 2-5) reduces hard water scaling. These results are used as a positive control for the evaluation of the compositions.

Example 2

In this Example, the wash system using a detergent containing no water conditioning polymer in combination with a rinse aid containing a water conditioning polymer were evaluated for their glasses and plastic film accumulation in an institutional dish wash machine by a hard water film accumulation test.

The detergent free of water conditioning polymer is shown in Table 1 as Detergent #1. Tables 3A-3C lists the rinse aid compositions that are used in this Example. The detergent was supplied at 1,000 ppm in the wash solutions and 2.8 mL of the rinse aid composition was used in each wash/rinse cycle.

TABLE 3A

Various Exemplary Compositions of the Rinse Aids for the Inventive Warewashing System (20 ppm)

| | Rinse Aid #1 | Rinse Aid #2 | Rinse Aid #3 | Rinse Aid #4 |
|---|---|---|---|---|
| DI Water | 95.84 | 95.56 | 96.00 | 95.35 |
| Flosperse 2308 (Acrylic maleic copolymer), 48% | 4.16 | 0 | 0 | 0 |
| Alcoguard 5853 (Starch/acrylic acid hybrid polymer), 45% | 0 | 4.44 | 0 | 0 |
| Belclene 200 (polymaleic acid homopolymer) 50% | 0 | 0 | 4.00 | 0 |
| Acumer 2000 (Acrylate/ATBS copolymer), 43% | 0 | 0 | 0 | 4.65 |
| Total | 100 | 100 | 100 | 100 |

TABLE 3B

Various Exemplary Compositions of the Rinse Aids for the Inventive Warewashing System (10 ppm)

| | Rinse Aid #5 | Rinse Aid #6 | Rinse Aid #7 | Rinse Aid #8 |
|---|---|---|---|---|
| DI Water | 97.92 | 97.78 | 98.00 | 97.67 |
| Flosperse 2308 (Acrylic maleic copolymer), 48% | 2.08 | 0 | 0 | 0 |
| Alcoguard 5853 (Starch/acrylic acid hybrid polymer), 45% | 0 | 2.22 | 0 | 0 |
| Belclene 200 (polymaleic acid homopolymer) 50% | 0 | 0 | 2 | 0 |
| Acumer 2000 (Acrylate/ATBS copolymer), 43% | 0 | 0 | 0 | 2.33 |
| Total | 100 | 100 | 100 | 100 |

TABLE 3C

Various Exemplary Compositions of the Rinse Aids for the Inventive Warewashing System (5 ppm)

| | Rinse Aid #9 | Rinse Aid #10 | Rinse Aid #11 | Rinse Aid #12 |
|---|---|---|---|---|
| Di Water | 98.96 | 98.89 | 99.00 | 98.83 |
| Flosperse 2308 (Acrylic maleic copolymer), 48% | 1.04 | 0 | 0 | 0 |
| Alcoguard 5853 (Starch/acrylic acid hybrid polymer), 45% | 0 | 1.11 | 0 | 0 |
| Belclene 200 (polymaleic acid homopolymer) 50% | 0 | 0 | 1 | 0 |
| Acumer 2000 (Acrylate/ATBS copolymer), 43% | 0 | 0 | 0 | 1.17 |
| Total | 100 | 100 | 100 | 100 |

The polymer concentration in the rinse aids are listed in Table 4. Table 4 lists the light box scores for the glasses and plastic after 100 cycles of wash and rinse with the detergent composition and rinse aid composition, respectively.

TABLE 4

Light Box Scores of the Glasses and Plastic after 100 Cycles of Wash/Rinse using the Detergent without a Polymer and Rinse Aid with or without a polymer.

| | Polymer | Polymer in Detergent (ppm) | Polymer in Rinse Aid (ppm) | Light Box Scores for Glasses | Light Box Scores for Plastic | Light Box Scores Total |
|---|---|---|---|---|---|---|
| D#1 + R#1 | Flosperse 2308 (Acrylic maleic copolymer) | 0 | 20 | 97961 | 33275 | 131236 |
| D#2 + R#2 | Alcoguard 5853 (Starch/acrylic acid hybrid polymer) | 0 | 20 | 102813 | 35115 | 137928 |
| D#1 + R#3 | Belclene 200 (polymaleic acid homopolymer) | 0 | 20 | 114748 | 33588 | 148336 |
| D#1 + R#4 | Acumer 2000 (Acrylate/ATBS copolymer) | 0 | 20 | 90148 | 65535 | 155683 |
| D#1 + R#5 | Flosperse 2308 (Acrylic maleic copolymer) | 0 | 10 | 92462 | 34729 | 127191 |
| D#1 + R#6 | Alcoguard 5853 (Starch/acrylic acid hybrid polymer) | 0 | 10 | 106619 | 57235 | 163854 |
| D#2 + R#7 | Belclene 200 (polymaleic acid homopolymer) | 0 | 10 | 94457 | 33288 | 127745 |
| D#1 + R#9 | Acumer 2000 (Acrylate/ATBS copolymer) | 0 | 10 | 95349 | 65535 | 160884 |
| D#1 + R#9 | Flosperse 2308 (Acrylic maleic copolymer) | 0 | 5 | 95653 | 40852 | 136505 |
| D#1 + R#10 | Alcoguard 5853 (Starch/acrylic acid hybrid polymer) | 0 | 5 | 104845 | 50881 | 155726 |
| D#1 + R#11 | Belclene 200 (polymaleic acid homopolymer) | 0 | 5 | 142124 | 32560 | 174684 |
| D#1 + R#12 | Acumer 2000 (Acrylate/ATBS copolymer) | 0 | 5 | 100328 | 52168 | 152496 |

The results in this Example show that the wash system disclosed herein further reduces hard water scaling as compared to a system with a detergent containing a water conditioning polymer and rinse aid composition without a water conditioning polymer. Furthermore, the results in Table 4 show that using the wash system disclosed herein can reduce the amount of water conditioning polymer used by incorporating it into the rinse aid composition (as opposed to the conventional detergent composition). As shown, using the same polymer in the rinse aid composition in the same or a reduced concentration achieve a similar or better hard water scaling performance. One can appreciate that even using the polymer in the same concentration still reduces the usage of the polymer since the rinse aid is applied in a smaller volume than that of the wash solution. In an aspect, the warewashing systems (and methods of employing the same) can include an alkaline detergent composition including a polycarboxylic acid polymer water conditioning agent and/or phosphonate and thereafter an acidic rinse composition including a polycarboxylic acid polymer water conditioning agent and/or phosphonate, wherein a reduced concentration of the polymers and/or phosphonates is achieved. Reducing usage of water conditioning agent during a cleaning process beneficially reduces the cost of the washing method and further reduces the impact on the environment.

Example 4

In this Example, additional water conditioning agents were evaluated in a rinse step compared to a conventional alkaline detergent wash step. The 100 cycle test procedure of Example 1 was employed with the glasses analyzed via image analysis. A lower score is indicative of less calcium carbonate precipitation, which is a desired result as the ware will be clear without precipitation and have a clean appearance.

FIG. 2 shows results for Flosperse 2308 (Acrylic maleic copolymer) showing a dramatic improvement in the wash system by removing the Flosperse 2308 from the detergent step and replacing it in the rinse step. Furthermore, the results in FIG. 2 show that using the polymer in the rinse step allows a reduction in the use of the water conditioning polymer in the rinse aid (as opposed to the conventional detergent composition). As shown, using the same polymer in the rinse aid composition in the same or a reduced concentration achieves substantially improved hard water scaling performance.

Figure 3:
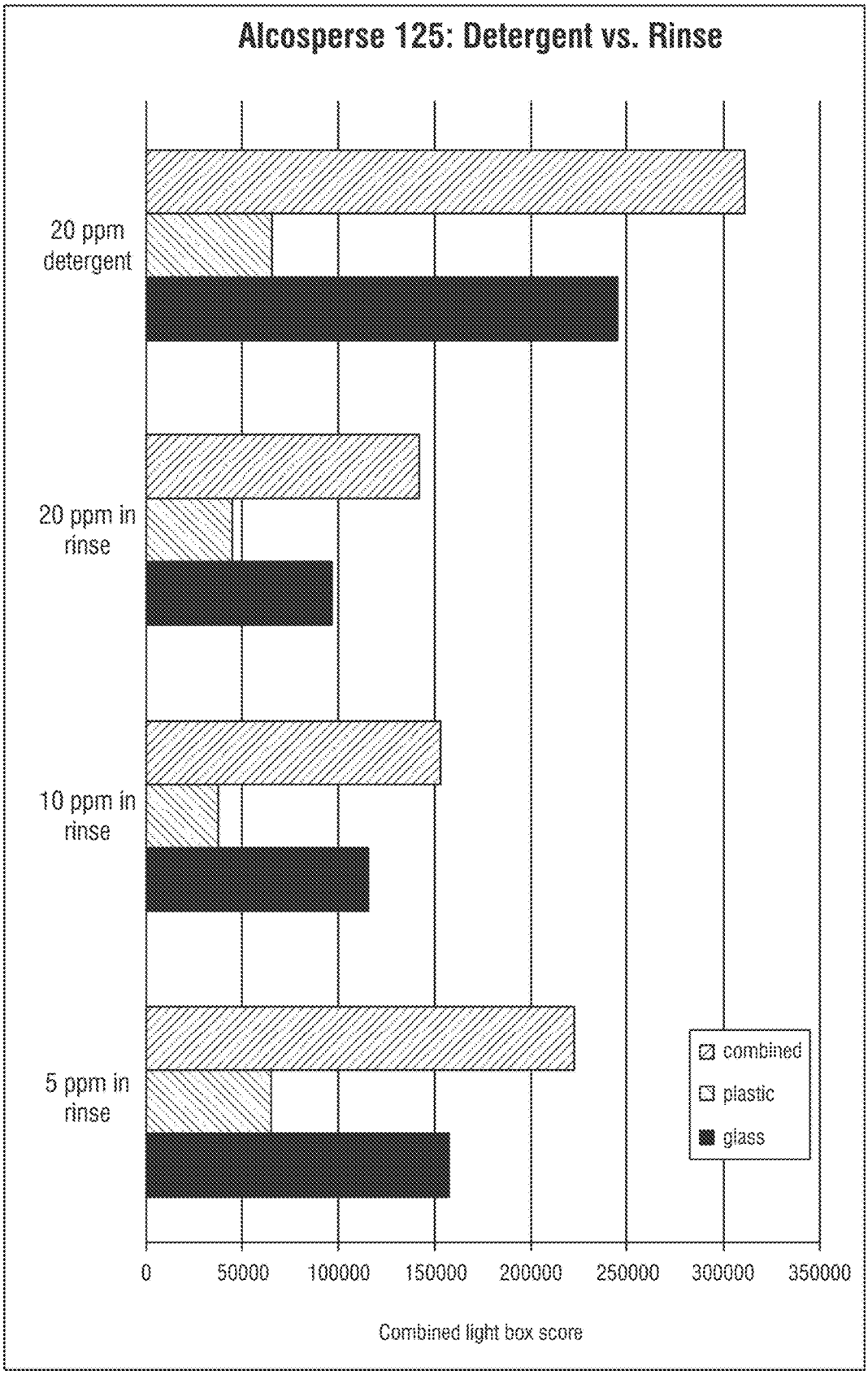
FIG. 3 shows light box evaluation scores for the commercially-available water conditioning agent Alcosperse 125 (methacrylate polymer) provided in a detergent composition compared to varying concentrations in the rinse aid composition.

FIG. 3 shows results for Alcosperse 125 (methacrylate polymer) showing a dramatic improvement in the wash system by removing the Alcosperse 125 from the detergent step and replacing it in the rinse step. Furthermore, the results in FIG. 3 show that using the polymer in the rinse step allows a reduction in the use of the water conditioning polymer in the rinse aid (as opposed to the conventional detergent composition). As shown, using the same polymer in the rinse aid composition in the same or a reduced concentration achieves substantially improved hard water scaling performance.

Figure 4:
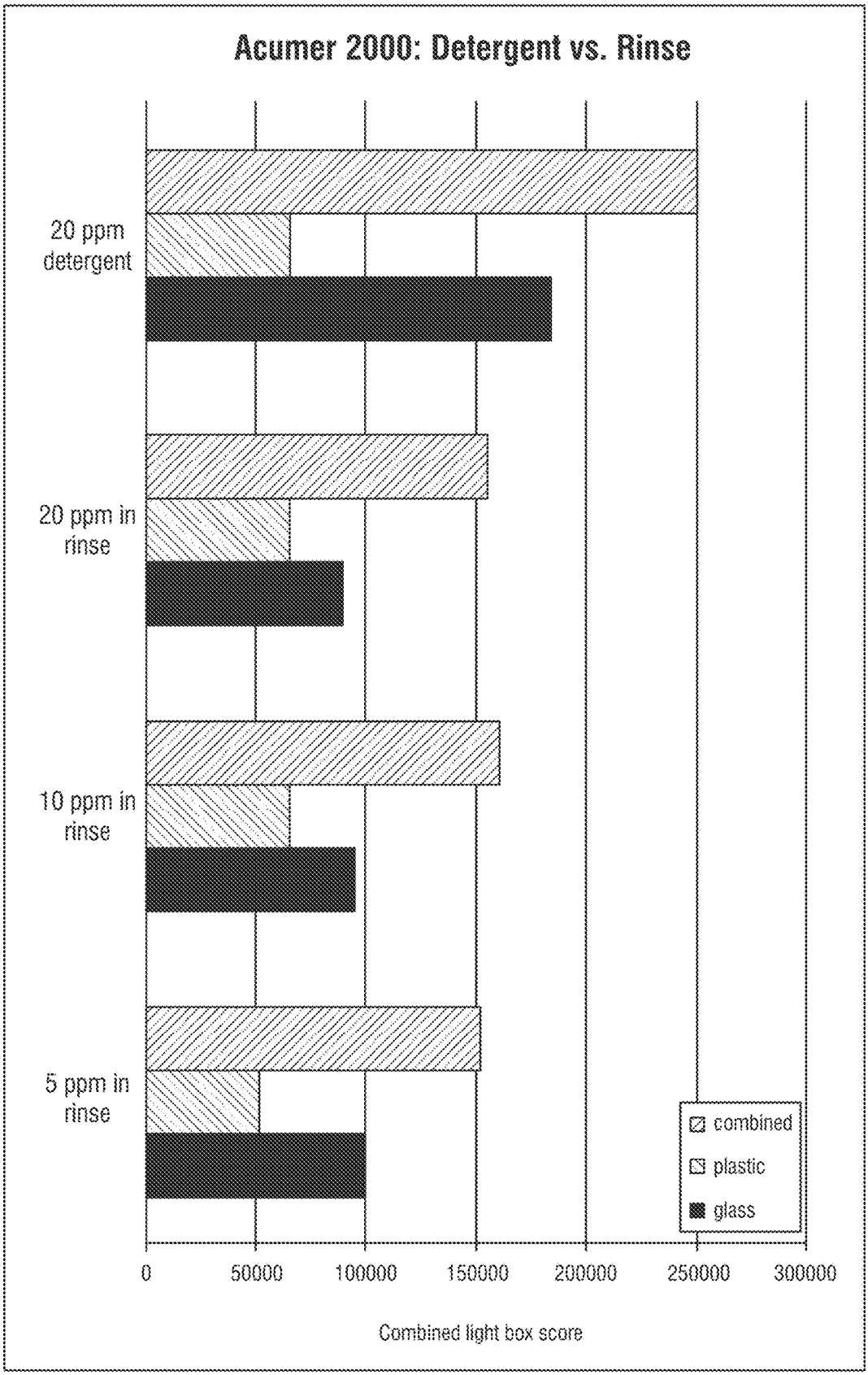
FIG. 4 shows light box evaluation scores for the commercially-available water conditioning agent Acumer 2000 (Acrylate/ATBS copolymer) provided in a detergent composition compared to varying concentrations in the rinse aid composition.

FIG. 4 shows results for Acumer 2000 (Acrylate/ATBS copolymer) showing a dramatic improvement in the wash system by removing the Acumer 2000 from the detergent step and replacing it in the rinse step. Furthermore, the results in FIG. 4 show that using the polymer in the rinse step allows a reduction in the use of the water conditioning polymer in the rinse aid (as opposed to the conventional detergent composition). As shown, using the same polymer in the rinse aid composition in the same or a reduced concentration achieves substantially improved hard water scaling performance.

Figure 5:
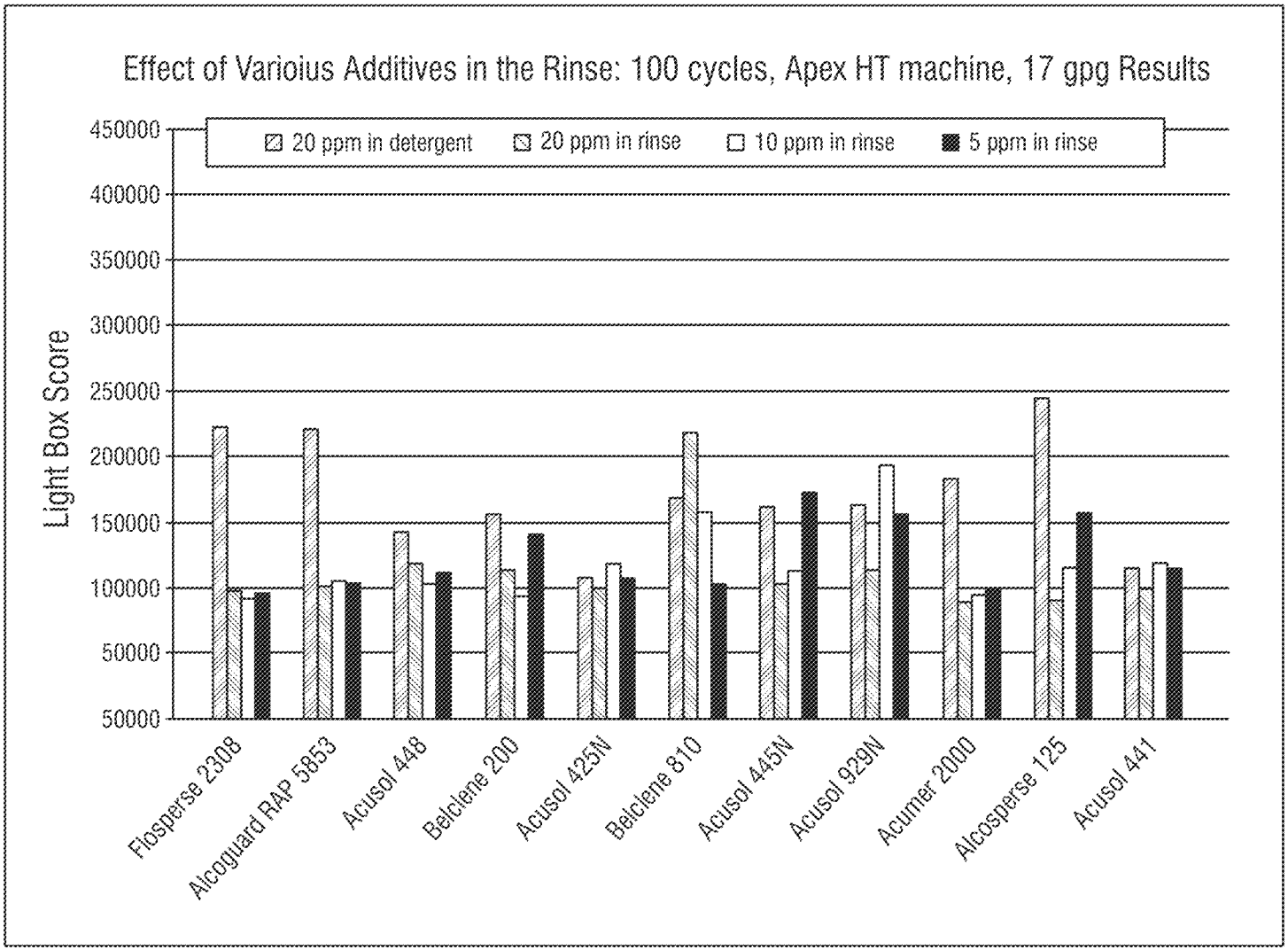
FIG. 5 shows comparative light box evaluation scores for various polymers and other components evaluated according to methods for benefits of removing the component from the detergent composition and replacing it in the rinse aid composition.

FIG. 5 shows the results from FIGS. 2-4 in addition to various other water conditioning polymers and other components screened for rinse aid efficacy. As shown in the Figure, the use of the polycarboxylic acid polymers in the rinse step allows a reduction in the use of the water conditioning polymer in the rinse aid (as opposed to the conventional detergent composition) while providing significant reduction in the light box scores, indicating substantially improved hard water scaling performance.

Example 5

In this Example, additional 100-cycle tests were conducted using phosphonate water conditioning agents to evaluate in a rinse step compared to a conventional alkaline detergent step. The methods of Example 1 were employed.

Table 5 shows 750 ppm ash 2 mL HEDP (0.7% active-5 ppm at use) in a rinse cycle as opposed to a detergent wash step.

TABLE 5

| GLASS SCORES | SUM GLASS SCORES |
|---|---|
| 19855<br>14058<br>19348 | 118921 |
| | SUM PLASTIC SCORES |
| 22559<br>22655<br>20446 | 45503 |
| PLASTIC SCORES | SUM COMBINED SCORES |
| 45503 | 164424 |

Table 6 shows 750 ppm ash 2 mL ATMP (0.7% active-5 ppm at use) in a rinse cycle as opposed to a detergent wash step.

TABLE 6

| GLASS SCORES | SUM GLASS SCORES |
|---|---|
| 15494<br>13261<br>16234 | 95074 |
| | SUM PLASTIC SCORES |
| 15389<br>15320<br>19376 | 43253 |
| PLASTIC SCORES | SUM COMBINED SCORES |
| 43253 | 138327 |

Table 7 shows 750 ppm ash 2 mL PBTC (0.7% active-5 ppm at use) in a rinse cycle as opposed to a detergent wash step.

TABLE 7

| GLASS GRADES | SUM GLASS SCORES |
|---|---|
| 18264<br>62455<br>36465 | 250606 |
| | SUM PLASTIC SCORES |
| 42312<br>64512<br>26598 | 41323 |
| PLASTIC GRADES | SUM COMBINED SCORES |
| 41323 | 291929 |

The results in Tables 5-7 show that a number of phosphonates provide efficacious rinsing and prevention of hard water scale on treated ware. The phosphonates HEDP and ATMP outperformed PBTC, DGAP and PAPEMP.

The inventions being thus described, it will be obvious that the same may be varied in many ways. Such variations are not to be regarded as a departure from the spirit and scope of the inventions and all such modifications are intended to be included within the scope of the following claims. Since many embodiments can be made without departing from the spirit and scope of the invention, the invention resides in the claims.

What is claimed is:

1. A method of warewashing comprising:

contacting ware with an alkaline detergent composition substantially free of scale-inhibiting water conditioning agents, wherein the scale-inhibiting water conditioning agents are polycarboxylic acid polymers and/or phosphonates; and thereafter contacting ware with a rinse composition comprising at least one scale-inhibiting water conditioning agent, wherein the scale-inhibiting water conditioning agent consists of phosphonate, reducing the overall consumption of scale-inhibiting water conditioning agents in the warewashing method by at least about 25% in comparison to warewashing methods employing scale-inhibiting water conditioning agents in the alkaline detergent composition.

2. The method of claim 1, wherein the alkaline detergent composition is substantially free of a methacrylate polymer, an acrylate polymer, an acrylic maleic copolymer, a polymaleic acid homopolymer, an acrylate/ATBS copolymer or combinations thereof.

3. The method of claim 1, wherein the detergent composition comprises less than about 0.1 wt-% scale-inhibiting water conditioning agents.

4. The method of claim 1, wherein the detergent composition is free of scale-inhibiting water conditioning agents.

5. The method of claim 1, wherein the detergent composition provides a pH from about 9 to about 12.5 in an aqueous solution, and wherein the rinse composition provides a pH from about 2 to about 8 in an aqueous solution.

6. The method of claim 1, wherein the alkaline detergent composition comprises an inorganic alkalinity source.

7. The method of claim 1, wherein the ware is kitchen ware.

8. The method of claim 1, wherein contacting of the alkaline detergent is at a temperature range from about 100° F. to about 180° F., and wherein the contacting of the rinse composition is at a temperature range from about 100° F. to about 200° F.

9. The method of claim 1, wherein the rinse composition is free of polyitaconic acid polymers.

10. The method of claim 1, wherein the rinse step does not result in precipitation on the treated ware.

11. The method of claim 1, wherein the scale-inhibiting water conditioning agent(s) in the rinse step provides superior cleaning of the ware and reduces the amount of scale-inhibiting water conditioning agent(s) by at least about 50% in comparison to conventional ware washing employing the scale-inhibiting water conditioning agent in a wash step.

12. The method of claim 1, wherein the method further comprises a sanitizing step after the rinse step.

13. The method of claim 1, wherein the rinse composition provides between about 0.5 ppm to about 40 ppm of the phosphonate.

14. The method of claim 1, wherein the detergent comprises an alkalinity source and at least two components that are water, a defoaming agent, a chelant that is not a polycarboxylic acid polymer, an enzyme and/or a surfactant, and wherein the rinse composition further comprises at least one additional component that is water, a defoaming agent, a sheeting agent, and/or a surfactant.

15. A method of dishwashing comprising:

contacting kitchen ware with an alkaline detergent composition that comprises less than about 0.1 wt-% water scale-inhibiting conditioning agents comprising polycarboxylic acid polymer and/or phosphonates; and thereafter contacting ware with a rinse composition comprising scale-inhibiting water conditioning agents consisting of phosphonates, wherein the rinse composition provides between about 0.5 ppm to about 40 ppm of the phosphonate and is free of polyitaconic acid polymers, reducing the overall consumption of scale inhibiting water conditioning agents in the dishwashing method by at least about 25% in comparison to dishwashing methods employing scale inhibiting water conditioning agents in the alkaline detergent composition;

wherein the method of dishwashing provides an improvement in scale inhibition and cleaning performance.

16. The method of claim 15, wherein the detergent comprises an alkalinity source and at least two components that are water, a defoaming agent, a chelant that is not a polycarboxylic acid polymer, an enzyme and/or a surfactant.

17. The method of claim 15, wherein the rinse composition further comprises at least one additional component that is water, a defoaming agent, a sheeting agent, and/or a surfactant.

18. The method of claim 15, wherein the method further comprises a sanitizing step after contacting the ware with the rinse composition.

19. The method of claim 15, wherein the detergent compositions provides a pH of the composition of from about 9 to about 12.5 in an aqueous solution, and wherein the rinse compositions provides a pH of the composition from about 2 to about 8 in an aqueous solution.

20. A warewashing system comprising:

an alkaline detergent composition substantially free of scale-inhibiting water conditioning agents comprising polycarboxylic acid polymer and/or phosphonates and providing a pH of the composition of from about 9 to about 12.5 in an aqueous solution; and a rinse composition comprising scale inhibiting water conditioning agent(s) consisting of phosphonates and providing a pH of the composition from about 2 to about 8 in an aqueous solution, a reduction in overall consumption of scale inhibiting water conditioning agent(s) in the warewashing system by at least about 25% compared to a warewashing system employing scale inhibiting water conditioning agent(s) in the detergent composition, wherein the alkaline detergent composition and thereafter rinse composition are dosed in a warewash machine and wherein the system provides at least substantially similar or an improvement in scale inhibition and at least substantially similar or an improvement in cleaning performance.

* * * * *